United States Patent [19]

Capasso

[11] Patent Number: 4,804,046

[45] Date of Patent: Feb. 14, 1989

[54] SHUT-OFF DEVICE FOR A SPRINKLER ASSEMBLY

[75] Inventor: Vincent J. Capasso, Lansdale, Pa.

[73] Assignee: Fire Sprinkler Specialties, Inc., Chalfont, Pa.

[21] Appl. No.: 67,479

[22] Filed: Jun. 29, 1987

Related U.S. Application Data

[63] Continuation-in-part of Ser. No. 834,594, Jun. 30, 1987, Pat. No. 4,676,320.

[51] Int. Cl.[4] ..... A62C 37/10

[52] U.S. Cl. ..... 169/90; 137/382.5

[58] Field of Search ..... 169/90, 57, 38, 37, 169/41; 137/382.5

[56] References Cited

U.S. PATENT DOCUMENTS 4,676,320 6/1987 Capasso ..... 169/90

FOREIGN PATENT DOCUMENTS 586992 4/1925 France ..... 169/57

643162 7/1979 U.S.S.R. ..... 169/57

*Primary Examiner*—Sherman D. Basinger

*Assistant Examiner*—Thomas J. Brahan

*Attorney, Agent, or Firm*—Joseph W. Molasky & Assocs.

[57] ABSTRACT

A device for terminating the flow of fluid from an overhead sprinkler equipped with a cut-off valve. The device provides a cut-off means for obturating fluid flow in sprinkler heads equipped with both a circular baffle and a baffle having a sidewall member for directing water into a limited area. When impressed onto the sprinkler head a recessed segment returns the cut-off valve to its original shut-down position and a biased locking means allows the user to secure the device against unintended discharge.

9 Claims, 4 Drawing Sheets

FIG. 4
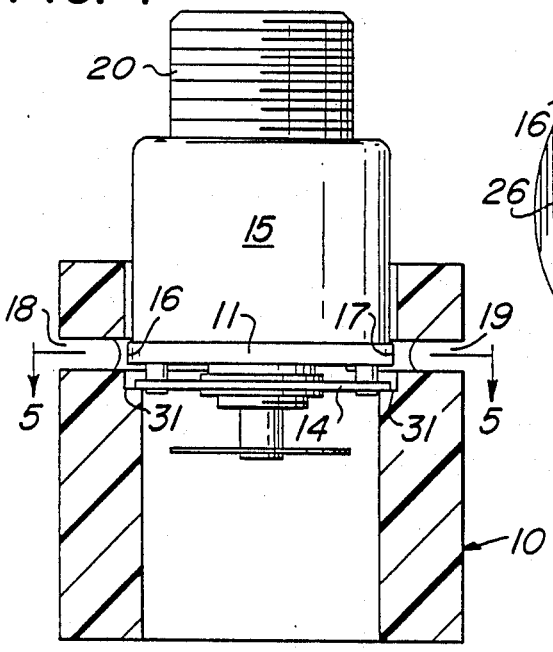
FIG. 5
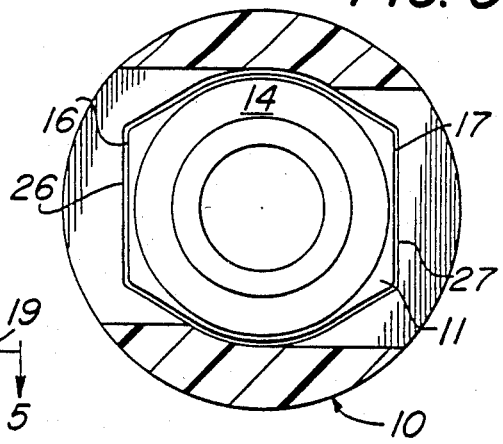
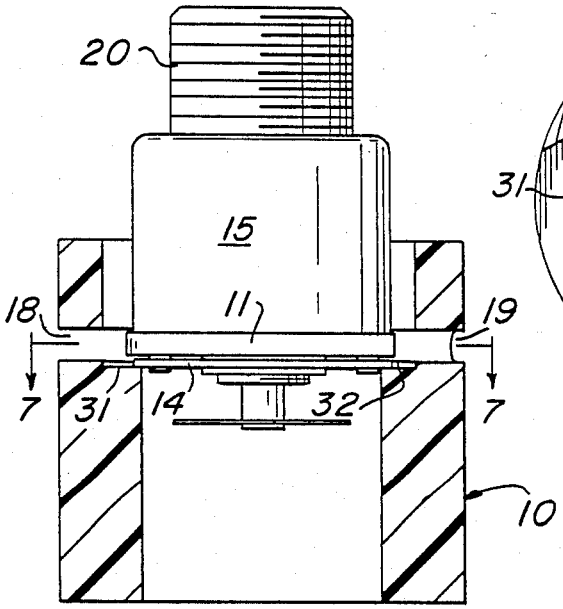
FIG. 6
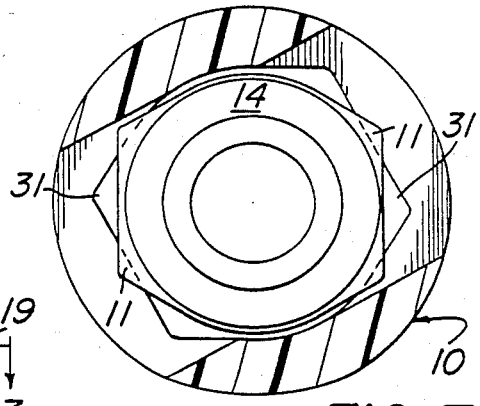
FIG. 7

FIG. 11
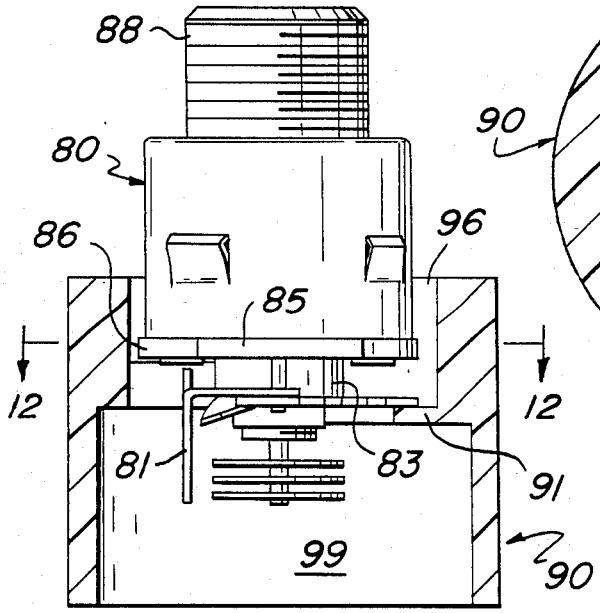
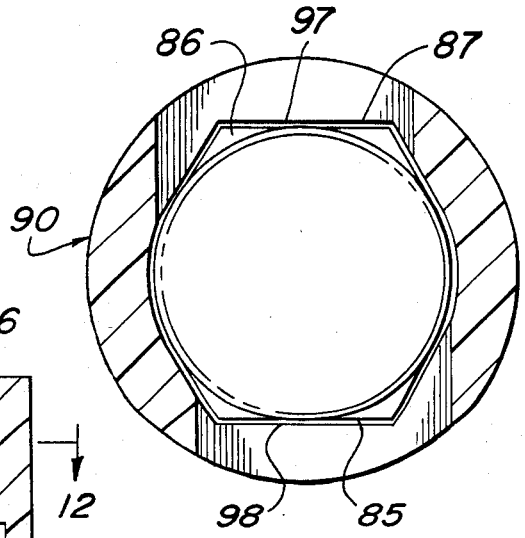
FIG. 12
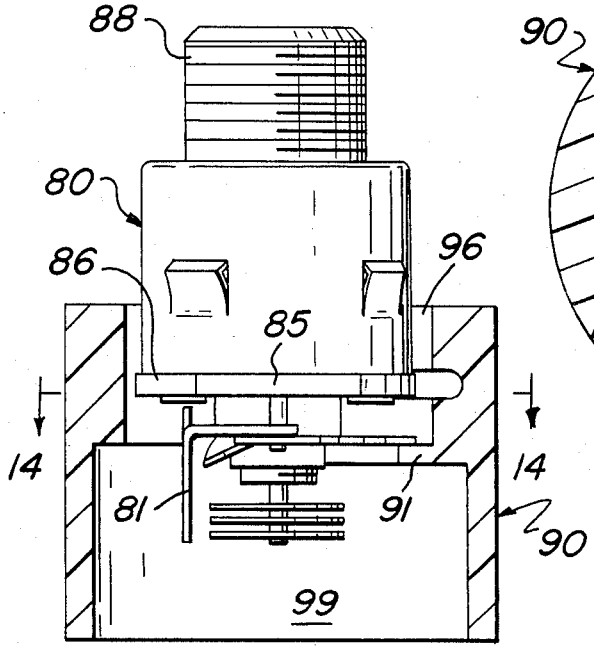
FIG. 13
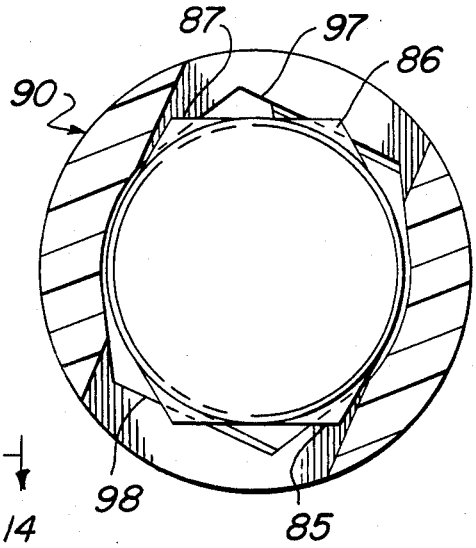
FIG. 14

SHUT-OFF DEVICE FOR A SPRINKLER ASSEMBLY

This application is a Continuation-in-part of application Ser. No. 834,594 which issued as U.S. Pat. No. 4,676,320 on June 30, 1987.

This invention relates to a closure device or cut-off for installation on an activated sprinkler head to terminate the flow of fire-extinguishing fluid.

More specifically, this invention relates to a hollow cylindrical body which interrupts the flow of fluid from a sprinkler head by impressing into the fluid-conveying orifice a shut-off valve which obturates fluid flow. A rotatable locking means secures said device to the sprinkler head and ensures against inadvertent discharge.

Once the device has been installed and fluid flow has been terminated the device is allowed to remain on the sprinkler assembly in a locked mode and it may remain in this state without impairing the sprinkler's ability to perform in its intended manner. This latter feature is the result of a novel product structure which allows the device to become fluid within a precise temperature range so that under ordinary sprinkler-activating conditions the device loses its locking ability, separates, and allows the sprinkler head to resume its fire-quenching operation.

BACKGROUND

Most closure or cut-off devices are awkward to install and they require the use of such force that damage to the sprinkler head often occurs.

When a fire has been brought under control the overhead sprinklers must be promptly inactivated to ensure that excess water will not inflict unnecessary damage. Many buildings are equipped with gravity-fed or pressure supplied water sources which discharge the fire-extinguishing fluid at rates which can flood a building within a relatively short period of time.

Accordingly, there is a need for a safe and effective device by which to ameliorate the damage which might result from a runaway sprinkler.

In U.S. Pat. No. 2,666,670, Vincent McGraw describes a closure device which installs easily and snaps away from the sprinkler head when the system is activated. However, this snap-away device has application only on dry sprinkler heads, that is, systems in which the heads do not contain a supply of fire-extinguishing fluid per se but which rely, instead, upon a water reservoir maintained at a remote source. The McGraw device has no application to wet sprinklers which contain within the head a supply of water for immediate discharge.

In U.S. Pat. No. 3,223,171, Walter DeGroot describes a closure plug comprised of telescoping members which are spring loaded. The spring has a compressive force which is at least equal to the force exerted by the water in the supply line to ensure that the plug will not be rejected. This plug is installed by the use of a mounting pole equipped with a triggering mechanism.

The DeGroot plug is neither inexpensive to manufacture or practical in its application because, in time, the spring assembly corrodes or loses its resiliency and becomes inoperable. Moreover, the inserted plug remains fixed and, as a consequence, the system cannot be reactivated until the plug is removed by hand.

From the foregoing it is obvious that a need exists for a closure device which can be used to terminate the flow of water from an activated sprinkler head in an effective, safe, convenient and inexpensive manner.

Moreover, there is a need for a closure device which can be allowed to remain on a sprinkler head in an inconspicuous manner and which does not require manual removal.

The present invention fills these needs by providing a closure device which can be manufactured inexpensively, installed easily and transported in volume without difficulty.

THE INVENTION

It is an object of this invention to provide a closure device for terminating water flow from an activated sprinkler head in an efficient manner with a modicum of effort.

More specifically, it is an object of this invention to provide a closure device which can be locked in place on an activated sprinkler head to obturate the flow of water and secure against inadvertent discharge.

Still another object is to provide a closure device which can be locked onto a sprinkler head without compromising its fire-extinguishing capabilities.

These and other objects are achieved by providing an integrally formed closure device which can be manufactured at low cost and installed rapidly in a safe and effective manner.

The device of this invention serves as a cut-off for sprinkler heads of the pendent and sidewall type, the first containing a baffle plate for distributing water in a uniform pattern in all directions and the latter a baffle plate equipped with fingers and a sidewall member for directing water in one direction only. Both cut-offs are described with particularity hereinafter in the description of the preferred embodiments. They differ somewhat in structure but they operate in an essentially identical manner.

Structurally, the device of this invention is a hollow cylindrical body contoured at one end to receive the flange and valve assembly of an activated sprinkler head. The contoured end includes a recess portion having sidewalls of generally oviform design for receiving the like-configured flange of said sprinkler head.

The contoured recess portion extends downwardly within the hollow cylindrical body and terminates in an abutment or seat for receiving the oviform-shaped flange and baffle plate of the sprinkler head assembly.

Immediately above said seat and directly opposite one another, within the recess portion, are channels which extend through the sidewalls so that they are visible from an outside view. Viewed from the inside the end segments of said channels tail off into depressions or grooves of gradually diminishing depth and they terminate in end segments of varying obliquity. At least one groove in each channel terminates in a biased end segment which is adapted to engage the flange of a sprinkler head valve assembly. This engagement results in a frictional locking means when the flange is turned in a clockwise direction and the cooperation is sufficient to retain the closure device on the sprinkler head until it is removed manually via a counterclockwsie rotation or by a melt-down as hereinafter described.

In conventional sprinkler heads a fluid cut-off valve is retained within the fluid emitting orifice by a fusible composition and so long as sealing temperatures remain below a designated level the composition will retain said valve and the fluid flow will remain obturated.

When the designated temperature level is reached the fusible composition melts, the prevailing pressure forces said valve out of said orifice and the sprinkler is activated.

The present device does not interfere with this mode of operation because it is fabricated from materials which melt at sprinkler-activating temperatures. Accordingly, when the temperature within a given area reaches critical levels the closure device of this invention becomes pliable and then yielding as it converts from a solid to a melted mass. As the melt-down continues the device becomes fluid and ultimately it falls away from the sprinkler head so that the liquid stream can be emitted without interference.

The materials from which the present device may be manufactured are, for example, thermoplastic resins having a melting point of from about 100°-250° C. and, preferably, 105°-120° C. Typical of these are, for example, cross-linked copolymeric resins derived from styrene and acrylonitrile which melt at temperatures of about 120° C. and, also, the copolymers of styrene, acrylonitrile and butadiene which exhibit a melting point range of from about 105°-115° C. Polysulfones, particularly the polyethersulfones, are also suitable as fabricating resins for the device of this invention, but the cross-linked reaction product of styrene and acrylonitrile is especially suitable and this resin constitutes a preferred fabricating material for this invention.

Other thermoplastic resins which may be employed are those derived from the copolymerization of trioxane with a minor amount of an acetyl comonomer. These resins possess carbon-to-carbon bonds in the polymer chain and they stabilize the polymer against various forms of degredative attack. Accordingly, when the copolymer is subjected to highly oxidative or acidic conditions the copolymer exhibits high stability and depolymerization generally stops short of the carbon-to-carbon link. Hydroxyethyl terminal units within the polymer chain also confer a high resistance to strongly alkaline environments. Copolymer resins which may be used to fabricate the device of this invention are those having a melting point range of from about 165°-250° C. as, for example, the resin known commercially as CELACON, a product of Celanese Engineering Resins of Chatham, N.J. which melts at about 165° C.

THE DRAWINGS

FIG. 4 is a side sectional view showing the combination of the closure device of this invention with a sprinkler head in its initial engagement stage.

FIG. 5 is a top sectional view of the closure device and sprinkler head shown in FIG. 4 along line 5—5.

FIG. 6 is a side sectional view showing the combination of the closure device of this invention with its sprinkler head assembly in the locking stage.

FIG. 7 is a top sectional view of the closure device and sprinkler head combination of FIG. 6 shown along line 7—7.

FIG. 11 is a side sectional view showing the closure device and sprinkler head of FIG. 8 in an initial engagement stage prior to locking.

FIG. 12 is a side sectional view of the closure device and sprinkler head shown in FIG. 11 along line 12—12.

FIG. 13 is a side sectional view of the closure device and sprinkler head of FIG. 8 in a locked mode.

FIG. 14 is a top sectional view of the closure device and sprinkler head shown in FIG. 13 along line 14—14.

THE EMBODIMENTS

Figure 1:
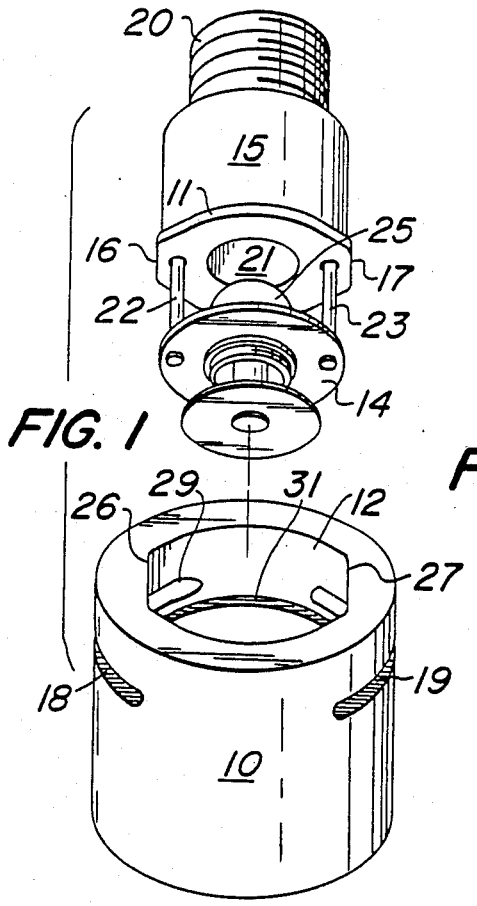
FIG. 1 is a perspective view of the closure device of this invention shown with a sprinkler head of the pendent type.

The cut-off for the pendent type sprinkler is the hollow cylindrical body shown as 10 in FIGS. 1-7. This body is contoured to receive and lock an activated sprinkler 15 and secure same against fluid flow.

The sprinkler to which this particular device applies is a commercial item for which no claim of novelty is asserted; however, its construction and mode of operation are relevant to the present invention and, therefore, its assembly is discussed in detail hereinbelow.

The sprinkler 15 includes a threaded conduit 20 for connecting to an overhead water supply (not shown), a fluid-emitting orifice 21 and a circumscribing flange 11 of generally oviform design.

Suspended beneath orifice 21 on guide rods 22 and 23 is a baffle plate 14 for receiving the liquid stream which is discharged from orifice 21 during a fire extinguishing operation. This baffle disperses the liquid in finely divided form and in a generally uniform pattern.

Figure 2:
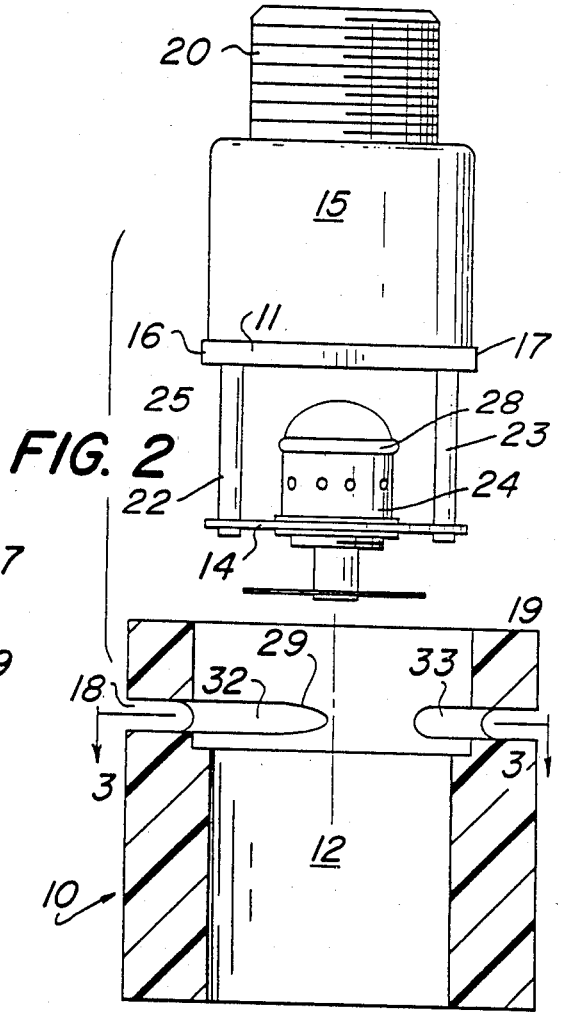
FIG. 2 is a side sectional view of the closure device of this invention shown in position for receiving the sprinkler head of FIG. 1.
Figure 3:
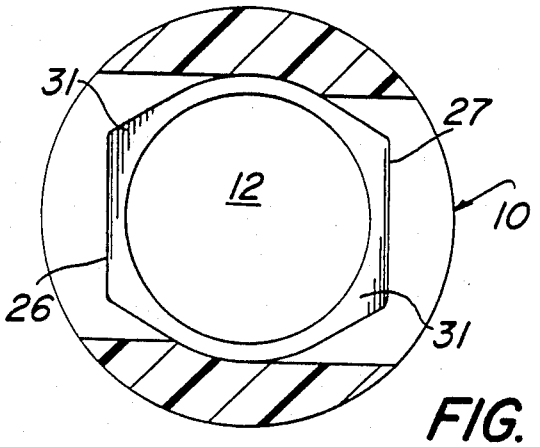
FIG. 3 is a top sectional view of the closure device of FIG. 2 along line 3—3.

The vertically disposed guide rods 22 and 23 cooperate with openings in flange 11 to provide means for raising and lowering said baffle plate and the attached valve 24 (FIG. 2). In FIGS. 1 and 2 the combination of baffle plate and valve are shown in an operational mode, that is, in position to receive the liquid stream which is to be discharged from orifice 21; whereas, FIGS. 4-7 show this assembly in a non-discharge mode.

The valve assembly includes a dome-shaped head 25 which guides valve 24 and the circumscribing rubber seal 28 into orifice 21 for engagement with conduit 20. When engagement occurs the seal 28 serves as a plug for terminating the liquid flow.

The interior of the present device includes a recess portion or cavity 12 which is contoured to receive the sprinkler head 11. This recess terminates in a seat 31 which extends laterally from the inner sidewalls of said recess to afford an abutment for engaging baffle plate 14.

Within said recess, immediately above seat 31, are opposing apertures which extend through the sidewall portion of said recess to form horizontal channels 18 and 19.

Externally, the device 10 is symmetrical and channel members 18 and 19 appear identical; however, an internal view shows that within recess 12 the channel members 18 and 19 extend laterally to form within the sidewall depressions of gradually diminishing depth. These depressions terminate in the oblique or biased segment shown as 29 in FIGS. 1 and 2. In these figures only the oblique segment for channel 18 is shown but both channels are identical and, therefore, it is to be understood that channel 19 terminates in an identical obliquity.

The device 10 will now be illustrated by describing its attachment to a pendent type sprinkler head assembly.

Operation: The pendent-type sprinkler shown as 15 in FIGS. 1 and 2 is a temperature-activated assembly 10 which employs a fusible composition to retain the cut-off valve 24 within the discharging orifice 21. So long as ambient temperatures remain below the melting point of this composition the valve 24 and its baffle plate attachment 14 will remain within conduit 20 and obturate the fluid flow.

The sprinkler is activated when an increase in temperature causes the fusible composition to melt and release its hold on sealing ring 28. When this occurs, the water pressure in conduit 20 expels the valve 24 and its baffle plate attachment from orifice 21 immediately ahead of the discharging stream. The stream thus emitted is converted into a uniform spray upon contact with dome 25, following which it is atomized to an even more finely divided dispersion by impingement on baffle plate 14.

The present device 10 terminates this fluid flow by returning valve 24 and sealing ring 28 into orifice 21. To achieve this result the device must first be aligned with the underside of said sprinkler so that its truncated segments 16 and 17 lie in registry with the identically configured end portions 26 and 27. When registry is assured the device 10 is impressed upwardly into sprinkler 15 so as to bring baffle plate 14 into engagement with seat 31 (FIGS. 4 & 5). This engagement also brings the baffle plate 14 into juxtaposition with flange 11 while simultaneously returning valve 24 and sealing ring 28 into conduit 20 where they serve as a seal against further fluid discharge. In this engagement mode segments 16 and 17 of flange 11 are visible through channels 18 and 19 and thus provide the operator with a visual means for ensuring registry.

The foregoing illustrates the means by which the present device is used to terminate fluid flow in an activated sprinkler of the pendent type but it does not ensure a permanent seal and, if left unattended, the pressure within conduit 20 will expel the valve and reactivate the sprinkler assembly. To ensure against this occurrence the valve must be locked so that it can be left unattended and secured against inadvertent discharge.

The sprinkler is locked and secured by turning the closure device 10 in a clockwise direction so as to bring flange 11 into engagement with biased segment 29 of aperture 18 (FIG. 2). An identical and simultaneous engagement also occurs between flange 11 and the biased segment of aperture 19 so that in its locking mode flange 11 and closure device 10 cooperate as shown in FIGS. 6 and 7.

Figure 8:
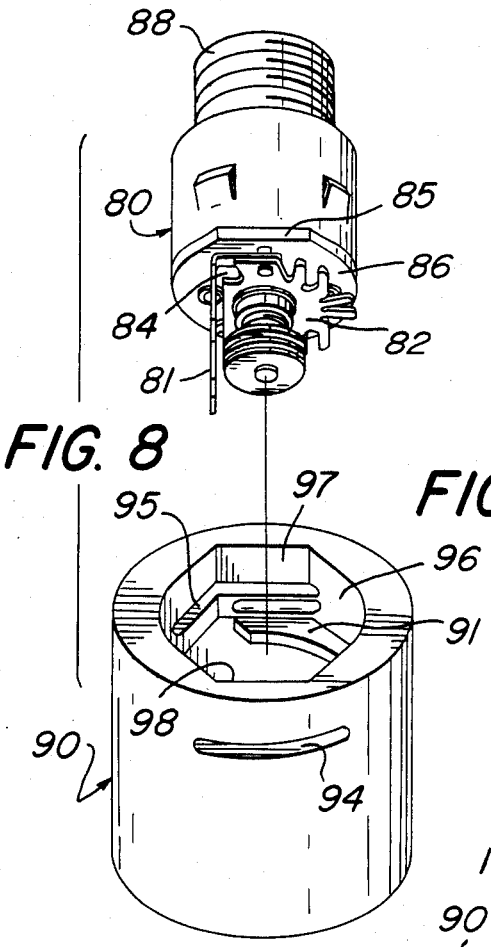
FIG. 8 is a perspective view of an alternative closure device according to this invention shown with a sprinkler head of the sidewall type.

In FIG. 8 there is shown an alternative device for obturating fluid flow from a sprinkler head of the sidewall type. This sprinkler 80 is essentially identical to the pendent-type sprinkler (15) shown in FIG. 1 except for their respective baffle plate assemblies.

In the pendent-type sprinkler 15 the circular baffle plate 14 distributes water uniformly in all directions but in the sidewall-type sprinkler 80 the vertically disposed member 81 and the horizontal baffle 82 with its projecting fingers and intervening recesses direct the water in one direction only.

The sidewall-type sprinkler 80 is activated when water pressure expels the valve assembly 83 (FIG. 9) from the water conveying orifice (not shown) as a result of which the emitted stream flows onto the surface of plate 82 where the water is impelled outwardly in the direction of the fingers and intervening recesses. At the same time, water is also directed downwardly in divergent streams through the opening 84 at the rear of said plate 82 for contact with the sidewall member 81.

The shut-off device 90 for this sidewall sprinkler 80 consists essentially of a chamber or recess portion 96 in which an arcuate seat 91 extends perpendicularly from the inner sidewalls of said chamber to form a projecting lip for engaging the baffle plate 82. The seat 91 traverses a portion only of said inner sidewalls and forms an abutment of determinate length so that the terminal ends 92 and 93 lie beneath the opposing apertures or channels 94 and 95.

The apertures 94 and 95 appear identical from an outside view but viewed internally, that is, from within the recess portion 96 they can be seen to form channels of gradually diminishing depth which terminate in oblique or biased segments which are identical to the oblique segment identified as 29 in FIGS. 1 and 2.

The application of this shut-off device 90 to the sprinkler head 80 will now be described in detail to illustrate its novel aspects and utilitarian features.

Figure 9:
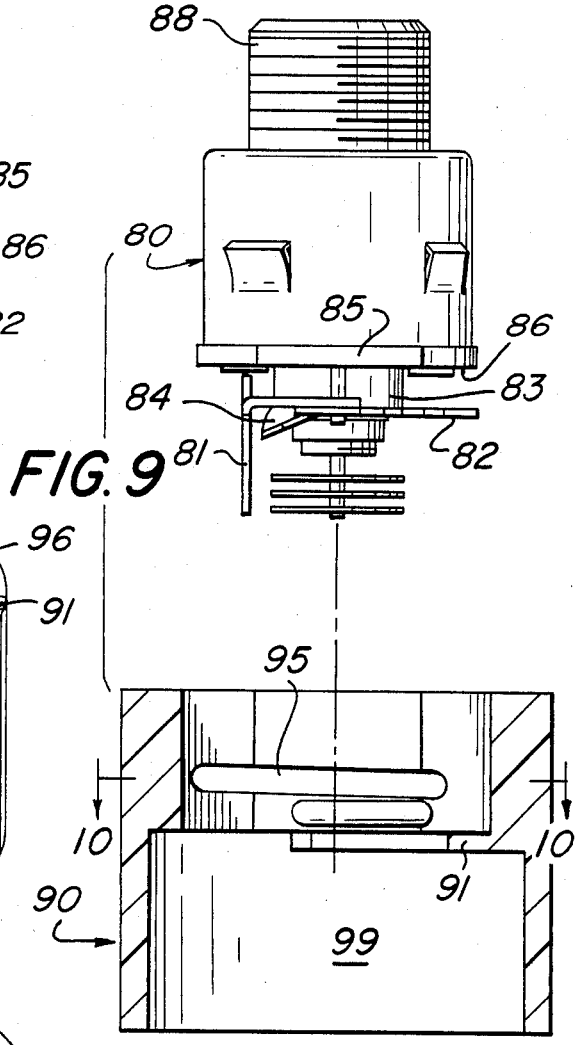
FIG. 9 is a side sectional view of the closure device of FIG. 8 shown in position for receiving the sprinkler head of FIG. 8.
Figure 10:
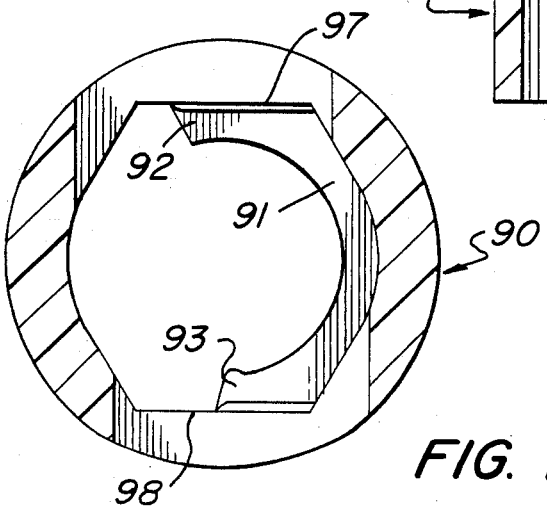
FIG. 10 is a top sectional view of the closure device shown in FIG. 9 along line 10—10.

Operation: To achieve a shut-off of fluid from an activated sidewall-type sprinkler head the device shown as 90 in FIGS. 8–14 must first be aligned with the underside of said head so that its truncated segments 97 and 98 lie in registry with the identically configured segments of said head. The aligned device 90 is then impressed upwardly onto said sprinkler head so as to bring the baffle 82 into engagement with seat 91 and allow the sidewall member 81 to enter annular chamber 99 (FIGS. 9, 11 and 13). This engagement returns the valve (not shown) of the sprinkler head 80 into engagement with the conduit 88 so as to stem the fluid flow while simultaneously placing the truncated segments of the sprinkler head flange 86 into conjunction with apertures 94 and 95 of the cut-off device.

The device 90 is locked onto the sprinkler head by turning same in a counterclockwise direction so as to bring the truncated ends of flange 86 into frictional engagement with the biased segments of apertures 94 and 95 and so long as this engagement exists the device 90 will remain captive and can be left unattended without fear of an inadvertent discharge. However, if a conflagration reoccurs the device of this invention will melt down at temperatures in the range of from about 100°–250° C. as a result of which the closure device 90 will lose its rigidity, the valve 83 will fall free and the sprinkler assembly will be automatically reactivated.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A device for terminating fluid flow in a temperature-activated sprinkler comprised of a water conduit, flange, baffle plate and cut-off valve, which comprises:

(1) a cylindrical hollow body having at one end a recess portion contoured to receive a flange of truncated oviform design said body being comprised of a thermoplastic composition which melts at temperatures corresponding essentially to sprinkler-activating temperatures;

(2) a flat seat which extends perpendicularly from the inner sidewalls of said body and abuts said recess portion, said seat being adapted to receive said baffle plate and simultaneously impress into said conduit a cut-off valve for terminating fluid flow; and (3) two apertures oppositely disposed within the sidewalls of said recess portion, both of which are adapted to engage said flange and provide a locking means.

2. The device according to claim 1 wherein said thermoplastic composition is a resin having a melting point of from about 100°–250° C.

3. The device according to claim 2 wherein said resin is a cross-linked copolymer having a melting point of from about 105°–120° C.

4. The device according to claim 2 wherein said resin is a copolymer derived from styrene and acrylonitrile.

5. A device for terminating fluid flow in a temperature-activated sprinkler comprised of a water conduit, flange, baffle plate and cut-off valve, which comprises:

(1) a cylindrical hollow body having at one end a recess portion contoured to receive a flange of truncated oviform design said body being comprised of a thermoplastic composition which melts at temperatures corresponding essentially to sprinkler-activating temperatures;

(2) a flat arcuate seat of determinate length extending perpendicularly from the inner sidewalls of said body to form a projecting lip which abuts a segment only of said recess portion, said seat being adapted to receive said baffle plate and simultaneously impress into said conduit a cut-off valve for terminating fluid flow; and (3) two longitudinal apertures oppositely disposed within the sidewalls of said recess portion, both of which are adapted to engage said flange and provide a locking means.

6. The device according to claim 5 wherein said apertures are horizontally disposed channels which are in juxtaposition with said seat.

7. The device according to claim 5 wherein the terminal ends of said seat lie essentially opposite one another beneath said longitudinal apertures.

8. The device according to claim 5 wherein said apertures are in registry with the truncated portion of said flange.

9. The device according to claim 8 wherein the flange-engaging apertures include a biased segment and engagement is achieved by frictional means.

* * * * *